US010262474B2

(12) United States Patent
Gortsas

(10) Patent No.: US 10,262,474 B2
(45) Date of Patent: Apr. 16, 2019

(54) METHOD FOR DETECTING A MALFUNCTION OF AT LEAST ONE SENSOR FOR CONTROLLING A RESTRAINING DEVICE OF A VEHICLE, CONTROL APPARATUS AND VEHICLE

(71) Applicant: Robert Bosch GmbH, Stuttgart (DE)

(72) Inventor: Nikolaos Gortsas, Sindelfingen (DE)

(73) Assignee: Robert Bosch GmbH, Stuttgart (DE)

( * ) Notice: Subject to any disclaimer, the term of this patent is extended or adjusted under 35 U.S.C. 154(b) by 165 days.

(21) Appl. No.: 15/334,328

(22) Filed: Oct. 26, 2016

(65) Prior Publication Data

US 2017/0116794 A1 Apr. 27, 2017

(30) Foreign Application Priority Data

Oct. 26, 2015 (DE) ..... 10 2015 220 823

(51) Int. Cl.
*G07C 5/08* (2006.01)

(52) U.S. Cl.
CPC ..... *G07C 5/0808* (2013.01)

(58) Field of Classification Search
None
See application file for complete search history.

(56) References Cited

U.S. PATENT DOCUMENTS 6,427,102 B1 * 7/2002 Ding ..... B60T 8/1755 701/29.2
7,899,595 B2 * 3/2011 Shimizu ..... B60R 21/0132 701/45
8,190,323 B2 * 5/2012 Maeda ..... G07C 5/085 701/33.4
2010/0066521 A1 * 3/2010 Yoshida ..... B60C 23/0401 340/438
2012/0044064 A1 * 2/2012 Maekawa ..... B60C 23/0408 340/447
2012/0159916 A1 * 6/2012 Ishii ..... A01D 34/64 56/10.2 A
2014/0095013 A1 * 4/2014 Wagner ..... B60C 23/0406 701/29.1

(Continued)

FOREIGN PATENT DOCUMENTS

CN 101758812 A 6/2010
JP 2005161996 A * 6/2005

(Continued)

OTHER PUBLICATIONS

Oba; Machine translation of JP-2005161996-A; Jun. 2005; espacenet.com (Year: 2005).*

(Continued)

*Primary Examiner* — David P. Merlino
(74) *Attorney, Agent, or Firm* — Maginot, Moore & Beck LLP

(57) ABSTRACT

The disclosure relates to a method for detecting a malfunction of at least one sensor for controlling a restraining device of a vehicle. In this context, in a first step a vehicle state signal representing a vehicle state of the vehicle is read in. In a second step a fault detection function for detecting the malfunction using the vehicle state signal is changed in order to detect the malfunction with a sensitivity level which is dependent on the vehicle state.

11 Claims, 2 Drawing Sheets

(56) References Cited

U.S. PATENT DOCUMENTS

2015/0266451 A1* 9/2015 Oohara ..... B60R 25/24
701/2

FOREIGN PATENT DOCUMENTS

JP 2008094119 A * 4/2008
JP 2016166767 A * 9/2016

OTHER PUBLICATIONS

Kageyama; Machine translation of JP-2016166767-A; Filed Mar. 2015; IP.com (Year: 2015).*
Tanaka; Machine translation of JP-2008094119-A; Apr. 2008; espacenet.com (Year: 2008).*
Ding, E.L.; Model-based diagnosis of sensor faults for ESP systems; Control Engineering Practice; Jul. 31, 2004; pp. 847-856 (10 pages).

* cited by examiner

METHOD FOR DETECTING A MALFUNCTION OF AT LEAST ONE SENSOR FOR CONTROLLING A RESTRAINING DEVICE OF A VEHICLE, CONTROL APPARATUS AND VEHICLE

This application claims priority under 35 U.S.C. § 119 to application no. DE 10 2015 220 823.0, filed on Oct. 26, 2015 in Germany, the disclosure of which is incorporated herein by reference in its entirety.

BACKGROUND

The disclosure relates to a device or a method. The subject matter of the present disclosure also relates to a computer program.

Modern vehicles can be equipped with a multiplicity of sensors. The signals made available by the sensors can be used to implement a wide variety of functions such as an airbag, ESP, engine control or damper regulation and a wide variety of driving aids, for example for autonomous driving. In order to avoid malfunctions, early detection of faulty sensors is important.

SUMMARY

Against this background, the approach presented here presents a method for detecting a malfunction of at least one sensor for controlling a restraining device of a vehicle, also a control apparatus which uses this method, and a vehicle as well as finally a corresponding computer program according to the main embodiments. Advantageous developments and improvements of the device specified in the main embodiments are possible by virtue of the measures disclosed in the further embodiments.

A method for detecting a malfunction of at least one sensor for controlling a restraining device of a vehicle is presented, wherein the method comprises the following steps:

reading in a vehicle state signal representing a vehicle state of the vehicle; and changing a fault detection function for detecting the malfunction using the vehicle state signal in order to detect the malfunction with a sensitivity level which is dependent on the vehicle state.

A sensor can be understood to be, for example, an acceleration sensor, rotational speed sensor or pressure sensor. The restraining device can be, for example, an airbag or a seat belt pretensioner. A vehicle state can be understood to be, for example, a normal driving mode, a parked position or a visit of the vehicle to a workshop. Correspondingly, the vehicle state signal can be, for example, a sensor signal representing a speed, an acceleration or an inclination of the vehicle, or else a surroundings variable which characterizes the vehicle state. Such an ambient variable can represent, for example, a signal relating to activation or deactivation of an ignition system, a parking brake or a door locking system, a specific transmission position, a pedal activation or a charging status of a battery of the vehicle. A fault detection function can be understood to be a function, a model or an algorithm by which the faulty signals made available by the sensor can be detected. A malfunction can be understood to be an operating state of the sensor in which the sensor emits a signal which at least temporarily leaves a predefined amplitude range. A sensitivity level can be understood to be a variable threshold or a threshold value at whose transgression the fault detection function detects the signal made available by the sensor as being faulty.

The approach presented here is based on the realization that by detecting a precise driving state of a vehicle it is possible to set a sensitivity level during the determination of malfunctions of a sensor of the vehicle as a function of the driving state. This has the advantage that depending on the driving state detected a detection depth which is as high as possible can be achieved, with the result that the risk of incorrect detections is minimized and the driving safety can be increased, for example by virtue of the fact that when a faulty sensor is detected the system can be placed in good time in a safe state, for example by activating a warning lamp, or a function which is coupled to the faulty sensor is limited or switched off.

Sensor faults are generally detected without knowledge of a current driving state during initialization of a control apparatus or in the normal driving mode. In order to achieve a good compromise between the detection depth and the possibility of incorrect detection, a corresponding fault detection function can be configured, for example, in such a way that the probability of an incorrect detection, for example owing to external influences or because of rare driving situations, is low. As a result, the detection depth can drop and therefore faulty sensors can remain in circulation over a relatively long time.

Since the vehicle state is known during the fault detection process it is possible also to detect such fault patterns which are not present over a relatively long time or not directional, wherein it is possible to differentiate reliably between an actual sensor defect and a temporary sensor disruption.

Using an adaptive fault detection process, such as is the subject matter of the approach presented here, it is possible to simplify and speed up the detection of sensor faults by providing the possibility of taking into account a current system state of the vehicle during the fault detection process. Knowledge of the current system state permits, for example, fault detection functions in a corresponding control apparatus or in sensors to be reprogrammed in such a way that limits corresponding to the system state are used to detect system faults.

The reprogramming or activation of the corresponding fault detection functions can take place, for example, by means of the detection of a parked position, either manually in a workshop or else automatically in the field. By using the current vehicle state to adapt fault detection functions, it is possible to detect a large class of faults in a short time. In this context, it is possible to differentiate between various driving states.

According to one embodiment, in the changing step a detection threshold can be changed to a first threshold value if the vehicle state signal represents a parked position of the vehicle. Additionally or alternatively, the detection threshold can be changed to a second threshold value if the vehicle state signal represents a driving mode of the vehicle. In this context, the first threshold value can represent a lower detection threshold than the second threshold value. A detection threshold can be understood to be a threshold on the basis of which the malfunction of the sensor can be detected. For example, the malfunction of the sensor is detected if a signal which is made available by the sensor exceeds the detection threshold. A parked position of the vehicle can be understood to be a vehicle state in which the vehicle is stationary. As already mentioned, the parked position can be detected using different ambient variables. Correspondingly, a driving mode of the vehicle can be understood to be a vehicle state in which the vehicle is moving along. By means of this embodiment, the sensitivity level of the fault detection function can be adapted as a function of a parked position and a driving mode of the vehicle.

It is advantageous if in the changing step the detection threshold is changed to a third threshold value if the vehicle state signal represents a visit of the vehicle to a workshop. In this context, the third threshold value can represent a lower detection threshold than the first threshold value. For example, the vehicle state signal representing the visit of the vehicle to the workshop can be made available by manually activating a corresponding switch or a corresponding manual input via a communication bus of the vehicle. Alternatively, the vehicle state signal can be automatically made available, for example during the reading in of a sensor signal which represents an essentially horizontal position of the vehicle when the vehicle is simultaneously stationary, or a power signal originating from an external power source. As a result of this embodiment, the fault detection function can be switched to a more sensitive setting when the vehicle is in a workshop than in the normal driving mode or in the parked position. As a result, a large class of sensor faults can be reliably detected.

According to a further embodiment, in the changing step the detection threshold can be changed to the third threshold value if the vehicle state signal also represents an essentially horizontal position of the vehicle. As a result, the probability of incorrect detections can be reduced.

Furthermore, in the changing step the detection threshold can be changed to the first threshold value if the vehicle state signal represents a state of the vehicle in which an ignition system of the vehicle is deactivated and/or a parking brake of the vehicle is activated and/or a parking position of a transmission of the vehicle is activated and/or a charging function for charging a battery of the vehicle is activated and/or a door locking system of the vehicle is activated and/or all the pedals of the vehicle are in a position of rest. By means of this embodiment it is possible to detect the parked position of the vehicle with a high level of reliability.

It is also advantageous if in the changing step an observation time during which the malfunction is observed is also changed to a first time value if the vehicle state signal represents the parked position. Additionally or alternatively, in the changing step the observation time can be changed to a second time value if the vehicle state signal represents the driving mode. In this context, the first time value can represent a shorter observation time than the second time value. An observation time can be understood to be a fault qualification time. By means of this embodiment, the reliability and the accuracy of the fault detection function can be improved further.

In this context, the observation time can be changed to a third time value if the vehicle state signal represents the visit of the vehicle to the workshop. The third time value can represent a shorter observation time than the first time value. By means of this embodiment it is possible for the accuracy of detection during a visit of the vehicle to the workshop to be improved, i.e. a relatively large class of sensor faults can be detected in a relatively short time.

According to a further embodiment, in the reading in step a sensor signal which is made available by the sensor can also be read in. In a checking step, the sensor signal can be checked for the malfunction using a fault detection function which is changed in the changing step. As a result, the functional capability of the sensor can be ensured.

This method may be implemented, for example, using software or hardware or using a mixed form of software and hardware, for example in a control apparatus.

The approach presented here also provides a control apparatus which is designed to carry out, actuate or implement the steps of a variant of a method presented here in corresponding devices. This embodiment variant of the disclosure in the form of a control apparatus also permits the object on which the disclosure is based to be achieved quickly and efficiently.

For this purpose, the control apparatus can have at least one computing unit for processing signals or data, at least one memory unit for storing signals or data, at least one interface with a sensor or an actuator for reading in sensor signals from the sensor or for outputting control signals to the actuator and/or at least one communication interface for reading in or outputting data which are embedded in a communication protocol. The computing unit can be, for example, a signal processor, a microcontroller or the like, wherein the memory unit can be a flash memory, an EPROM or a magnetic memory unit. The communication interface can be designed to read in or output data in a wireless fashion and/or wire bound fashion, wherein a communication interface can read in or output the line-bound data, read in these data, for example, electrically or optically from a corresponding data transmission line or output said data into a corresponding data transmission line.

A control apparatus can be understood to be here an electrical apparatus which processes sensor signals and outputs control signals and/or data signals as a function thereof. The control apparatus can have an interface which can be embodied by means of hardware and/or software. In the case of a hardware embodiment, the interfaces may be, for example, part of what is referred to as a system ASIC which includes a wide variety of functions of the control apparatus. However, it is also possible for the interfaces to be separate integrated circuits or to be composed at least partially of discrete components. In the case of an embodiment by means of software, the interfaces can be software modules which are present, for example, in a microcontroller along with other software modules.

In one advantageous refinement, the control apparatus carries out control of the restraining device of the vehicle. For this purpose, the control apparatus can access, for example, control signals such as acceleration signals, rotational speed signals or pressure signals. The actuation is carried out by means of actuators such as, for example, ignition capsules or magnetic actuators.

The approach presented here also provides a vehicle having the following features:

a restraining device;

at least one sensor (for example for controlling the restraining device); and a control apparatus according to an embodiment as above coupled to the sensor.

It is also advantageous to have a computer program product or computer program with program code which can be stored on a machine-readable carrier or storage medium such as a semiconductor memory, a hard disk memory or an optical memory and is used to carry out, implement and/or actuate the steps of the method according to one of the embodiments described above, in particular if the program product or program is executed on a computer or a device.

BRIEF DESCRIPTION OF THE DRAWINGS

Exemplary embodiments of the disclosure are presented in the drawings an are explained in more detail in the description below.

In the drawings.

DETAILED DESCRIPTION

In the following description of advantageous exemplary embodiments of the present disclosure, identical or similar reference symbols are used for the similarly acting elements which are illustrated in the various figures, without a repeated description of these elements.

Figure 1:
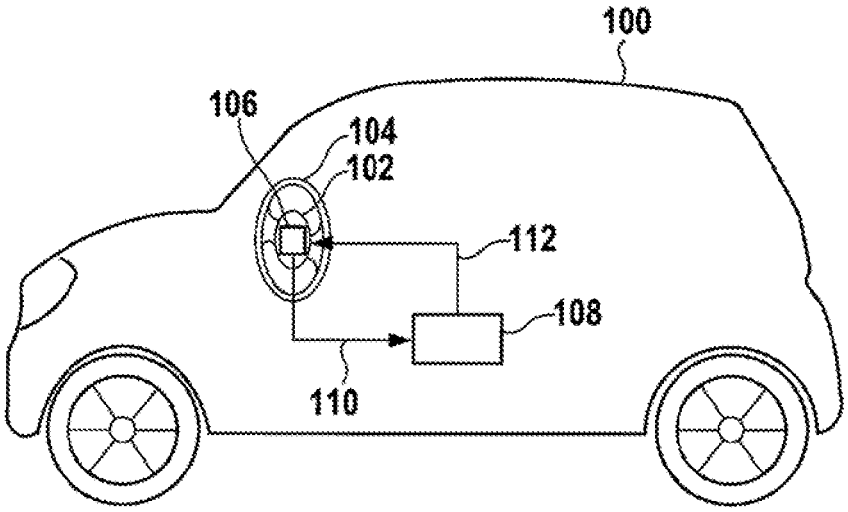
FIG. 1 shows a schematic illustration of a vehicle according to an exemplary embodiment.

FIG. 1 shows a schematic illustration of a vehicle 100 according to an exemplary embodiment. The vehicle 100 comprises a restraining device 102, here an airbag which is installed in a steering wheel 104, a sensor 106 for controlling the restraining device 102 and a control apparatus 108 which is designed to change the fault detection function for detecting a malfunction of the sensor 106 as a function of a detected vehicle state of the vehicle 100.

According to this exemplary embodiment, the control apparatus 108 is designed also to read in a sensor signal 110 which is made available by the sensor 106 and to check said sensor signal 110 for the malfunction using the fault detection function, changed as a function of the vehicle state, with a corresponding sensitivity level. If the malfunction is detected here, the control apparatus 108 makes available, for example, a control signal 112 for controlling the restraining device 102, for example in order to deactivate the restraining device 102 when a malfunction of the sensor 106 is detected. In this context, a sensor 106 or a plurality of corresponding sensors can be located in the control apparatus 108 or else in the periphery. The blocking of the ignition system is carried out, for example, in the control apparatus 108 itself.

Figure 2:
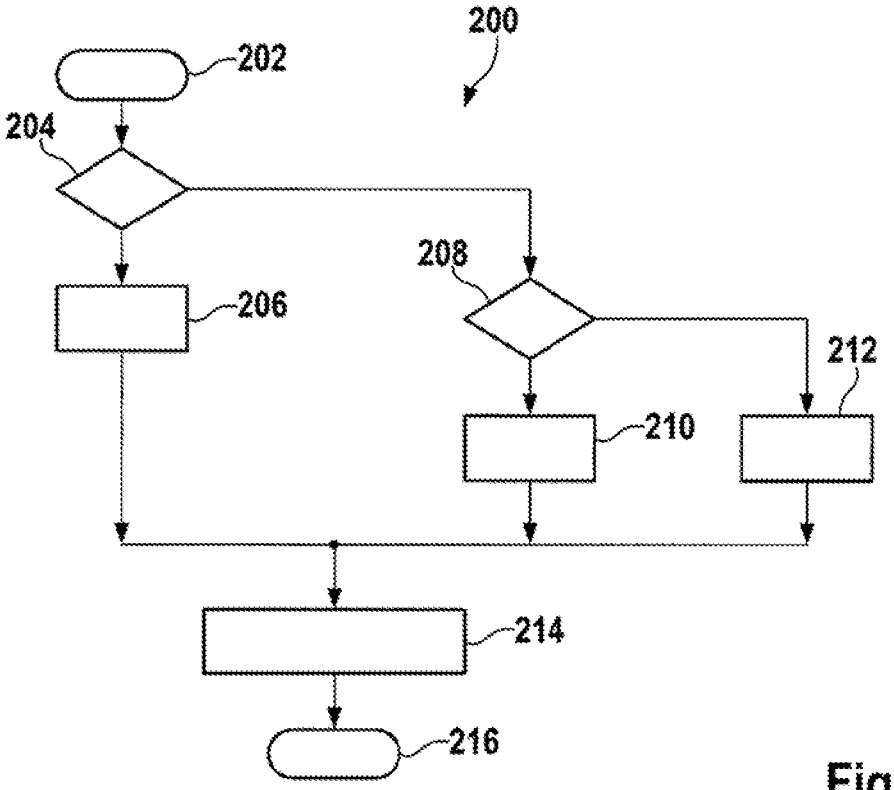
FIG. 2 shows a flow chart of a method according to an exemplary embodiment.

FIG. 2 shows a flow chart of a method 200 according to an exemplary embodiment. The method 200 can be carried out or actuated, for example, by a control apparatus such as is described above with respect to FIG. 1. The method 200 is started with a step 202. In a step 204 it is checked whether the vehicle is in a workshop. If the workshop is detected in step 204, in a step 206 a sensitive fault detection strategy is read in. If, on the other hand, the workshop is not detected in step 204, in a step 208 it is checked whether the vehicle is in a parked position. If it becomes apparent in step 208 that the vehicle is in the parked position, in a step 210 a robust fault detection strategy is read in. Otherwise, in a step 212 a very robust fault detection strategy is read in. In response to this, in a step 214 the fault detection function is adapted in accordance with the read-in fault detection strategy. In step 216, the method 200 is ended or interrupted.

Figure 3:
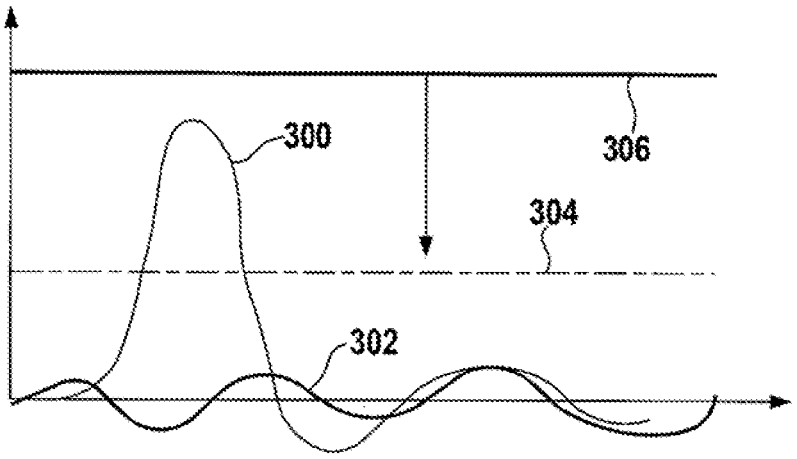
FIG. 3 shows a schematic illustration of two signal profiles for processing by means of a control apparatus according to an exemplary embodiment.

FIG. 3 shows a schematic illustration of two signal profiles 300, 302 for processing by means of a control apparatus according to an exemplary embodiment. The signal profiles 300, 302 may be processed, for example, by a control apparatus described above with respect to FIGS. 1 and 2. The first signal profile 300 represents a sensor fault of the sensor, while the second signal profile 302 represents a correct, here sinusoidal, signal profile in a parked position of the vehicle. In addition, a first threshold value 304 for fault detection in the parked position is shown here, characterized by a dashed line, and a second threshold value 306 is shown for fault detection in the normal mode of the vehicle is shown, characterized by a continuous line.

The first signal profile 300 has an amplitude which significantly exceeds the first threshold value 304, but is still below the second threshold value 306. The amplitude of the second signal profile 302 is clearly below the first threshold value 304.

For example, the detection threshold for the detection of sensor faults in the control apparatus in the normal mode of the vehicle is set to robust by means of the second threshold value 306, with the result that an incorrect detection is excluded as far as possible. If the vehicle state is known, for example the parked position, the detection threshold is reduced to the first threshold value 304. An arrow which is directed downward marks, in FIG. 3, a sensitivity level of the fault detection function which corresponds to the reduction in the detection threshold. In this way, a relatively large class of sensor faults can be deactivated in a relatively short time.

Figure 4:
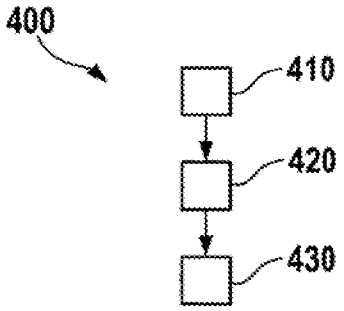
FIG. 4 shows a flow chart of a method according to an exemplary embodiment.

FIG. 4 shows a flow chart of a method 400 according to an exemplary embodiment. The method 400 may be carried out or actuated, for example by a control apparatus described above with respect to FIGS. 1 to 3. In this context, in a step 410, a vehicle state signal representing a vehicle state of the vehicle is read in. In a further step 420, the fault detection function is changed using the vehicle state signal, in order to detect the malfunction with a sensitivity level which is dependent on the vehicle state.

Depending on the exemplary embodiment, the steps 410, 420 can be executed continuously or repeatedly at certain time intervals.

According to one exemplary embodiment, in step 410 a sensor signal which is made available by the sensor is additionally read in. Accordingly, in an optional step 430 the sensor signal is checked for the malfunction using the fault detection function, changed in the step 420, with a sensitivity level corresponding to the vehicle state.

For example, the vehicle can be shutdown and energized on a planar surface during a visit to a workshop. By means of an external signal it is possible to communicate to the control apparatus of the vehicle via a communication bus that the vehicle is in a defined state, for example in a horizontal plane in the position of rest in the workshop. According to one exemplary embodiment, the control apparatus which is connected to the communication bus is designed to process the external signal in order to switch the fault detection functions in the control apparatus or in the sensor to a more sensitive setting than in the normal driving mode. By virtue of the operation of the control apparatus over a relatively long time in a constant environment it is possible to detect reliably a large class of sensor faults. This also applies to faults which otherwise remain undiscovered, for example because they are similar to actual application signals.

According to a further exemplary embodiment, a central control unit of the vehicle is designed to detect a parked state of the vehicle, while the vehicle is shut down, and to automatically start fault detection routines for all the control apparatuses connected to the communication bus. The fault detection routines in this state operate differently than those which are activated during a visit to a workshop because the parked state is determined differently than the state of the vehicle in a horizontal position in the workshop. For example, in parking on a sloping position certain sensors such as, for example, an offset-stable acceleration sensor indicate a value of less than 1 g in the vertical direction without a sensor fault being present.

For example, the control unit can be designed to detect the parked state repeatedly, distributed with a relatively low frequency over the day and to automatically activate fault detection routines. In this context, the fault detection routines can be stopped as soon as instructions relating to starting up of the vehicle are available. For example, by evaluating ambient variables it is possible to determine whether the vehicle is in the parked state. This is detected, for example, by virtue of the fact that an ignition key is present, a person is detected sitting on the driver seat, a parking brake is released, an accelerator pedal or brake pedal or the clutch is actuated or the doors of the vehicle are not closed. The parked state is therefore not detected using sensors, which are, of course, to be checked particularly for faults, but rather on the basis of the ambient variables.

In the case of electric vehicles, it is possible, for example when connecting the vehicle to a charging station, to transmit a signal to the communication bus by means of which the parked state can be detected or its plausibility can be additionally checked. Therefore, the fault detection function can be switched to a more sensitive setting by means of such a charging signal.

The detection of the parked state is carried out, for example, in an airbag or in an ESP control apparatus.

In the text which follows, three possible fault detection strategies of the fault detection function are described.

A sensitive fault detection strategy is used, in particular, when the vehicle state is known very precisely. This can be a visit to a workshop during which the vehicle is shut down on a horizontal plane. A very robust fault detection strategy is used in the normal driving mode and is characterized by detection thresholds and fault qualification times which can take into account not only the normal travel but also limiting value driving situations. A robust fault detection strategy is present between the two specified extremes. The robust fault detection strategy operates more sensitively than the very robust fault detection strategy in the normal driving mode but more robustly than the sensitive fault detection strategy, since in the parked state external influences cannot be excluded and the horizontal position of the vehicle cannot be ensured.

The fault detection strategies illustrated in the following table can be permanently programmed into the control apparatus and read in, for example, according to a method from FIG. 2 depending on the detected driving situation.

| Fault detection strategy: | Field of use: |
|---|---|
| sensitive | manual activation in the workshop in a horizontal position |
| robust | automatic detection of the parked state |
| very robust | vehicle mode |

For example, in order to activate the sensitive fault detection strategy in a workshop by means of a diagnostic function a workshop detection signal is transmitted to an airbag control apparatus. The workshop detection signal is transmitted only when the vehicle is shut down essentially in a horizontal position and no maintenance work is being carried out on the vehicle. When the workshop detection signal is received, the detection thresholds and the fault qualification times are switched over from the very robust to the sensitive fault detection strategy. By means of the operation of the control apparatus over a relatively long time in a defined state it is possible to detect signal profiles as illustrated by way of example in FIG. 3. As a result it is possible to prevent the system being subjected to faulty signals over a relatively long time. For example, as a result it is possible in the case of a acceleration sensor for a frontal crash detection to prevent the airbag control apparatus from incorrectly activating an airbag.

The parked state is detected, for example, when the vehicle is not in the workshop mode. The detection is carried out, for example, by evaluating suitable ambient variables such as:

- Ignition key not inserted.
- Parking brake is active.
- Constant gear speed or, in the case of vehicles with automatic transmissions, parking position is active.
- Pedals are in the position of rest.
- In the case of electric vehicles: a signal is present on the communication bus which indicates external charging of a vehicle battery.
- The vehicle is shut down.

As soon as the parked state is detected, pre-programmed detection thresholds which are stored, for example, in an EEPROM, are read out and activated. As a result, instead of the very robust fault detection strategy which is active during normal travel a strategy is used which employs relatively tight limits and relatively short fault qualification times. As a result, the detection depth is increased without the risk of an incorrect detection increasing significantly.

If the workshop detection signal is not read in, the parked state is not detected or a fault detection run is not interrupted, the very robust fault detection strategy is employed, the detection thresholds of which are very high and the fault qualification times of which are relatively long. It is therefore possible to virtually exclude incorrect detections in the driving mode during a normal journey but also in limit value driving situations.

Figure 5:
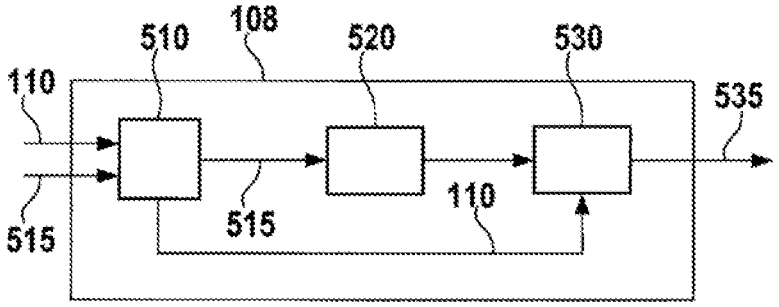
FIG. 5 shows a block diagram of a control apparatus according to an exemplary embodiment.

FIG. 5 shows a block diagram of a control apparatus 108 according to an exemplary embodiment, for example of a control apparatus, as is described above with respect to FIGS. 1 to 4. The control apparatus 108 comprises a reading-in unit 510 which is designed to read in a driving state signal 515 representing a state of the vehicle and to pass on said driving state signal 515 to a change unit 520. The change unit 520 is designed to change the fault detection function using the driving state signal 515 in order to detect the malfunction of the sensor of the restraining device in such a way that the malfunction is detected with a sensitivity level which is dependent on the vehicle state.

According to one optional exemplary embodiment, the reading in unit 510 is designed to read in, in addition to the driving state signal 515, the sensor signal 110 which is made available by the sensor, and to pass on said sensor signal 110 to an optional checking unit 530. The checking unit 530 then checks, using the fault detection function changed by means of the change unit 520, whether the sensor signal 110 has a signal profile which indicates a malfunction of the sensor.

According to a further exemplary embodiment, the checking unit 530 is designed to make available, as a function of a result of the checking of the sensor signal 110, a control signal 535 for controlling the sensor or the restraining device, for example in order to deactivate the sensor or the restraining device when a malfunction of the sensor is detected.

If an exemplary embodiment comprises an "and/or" conjunction between a first feature and a second feature, this is to be interpreted as meaning that the exemplary embodiment according to one embodiment has both the first feature and the second feature, and according to a further embodiment has either only the first feature or only the second feature.

What is claimed is:

1. A method for detecting a malfunction of at least one sensor configured to control activation of an airbag of a vehicle, the method comprising:

receiving a sensor signal from the at least one sensor;

receiving a vehicle state signal representing a vehicle state of the vehicle;

setting a detection threshold depending on the vehicle state signal;

detecting the malfunction of the at least one sensor in response to an amplitude of the sensor signal exceeding the detection threshold; and disabling activation of the airbag in response to detecting the malfunction of the at least one sensor.

2. The method according to claim 1, further comprising:

changing the detection threshold to (i) a first threshold value in response to the vehicle state signal representing a parked position of the vehicle and (ii) a second threshold value in response to the vehicle state signal representing a driving mode of the vehicle, the first threshold value being less than the second threshold value.

3. The method according to claim 2, further comprising:

changing the detection threshold to a third threshold value in response to the vehicle state signal representing a visit of the vehicle to a workshop, the third threshold value being less than the first threshold value.

4. The method according to claim 3, further comprising:

changing the detection threshold to the third threshold value in response to the vehicle state signal representing that a corresponding switch has been manually activated.

5. The method according to claim 2, further comprising:

changing the detection threshold to the first threshold value in response to the vehicle state signal representing a state of the vehicle in which at least one of:

an ignition system of the vehicle is deactivated;

a parking brake of the vehicle is activated;

a parking position of a transmission of the vehicle is activated;

a charging function for charging a battery of the vehicle is activated;

a door locking system of the vehicle is activated; and all pedals of the vehicle are in a position of rest.

6. The method according to claim 2, further comprising:

changing an observation time during which the malfunction is observed to (i) a first time value in response to the vehicle state signal representing the parked position and (ii) a second time value in response to the vehicle state signal representing the driving mode, the first time value representing a shorter observation time than the second time value.

7. The method according to claim 6, further comprising:

changing the observation time to a third time value in response to the vehicle state signal representing a visit of the vehicle to a workshop, the third time value representing a shorter observation time than the first time value.

8. The method according to claim 1, wherein the method is carried out by computer program.

9. The method according to claim 8, wherein the computer program is stored on a machine-readable storage medium.

10. A control apparatus comprising:

a controller operably connected to at least one sensor configured to control activation of an airbag, the controller configured to:

receive a sensor signal from the at least one sensor;

receive a vehicle state signal representing a vehicle state of the vehicle;

set a detection threshold depending on the vehicle state signal;

detect a malfunction of the at least one sensor in response to an amplitude of the sensor signal exceeding the detection threshold; and disable activation of the airbag in response to detecting the malfunction of the at least one sensor.

11. A vehicle comprising an airbag;

at least one sensor configured to control activation of the airbag; and a controller operably connected to the at least one sensor, the controller configured to:

receive a sensor signal from the at least one sensor;

receive a vehicle state signal representing a vehicle state of the vehicle; and set a detection threshold depending on the vehicle state signal;

detect a malfunction of the at least one sensor in response to an amplitude of the sensor signal exceeding the detection threshold; and disable activation of the airbag in response to detecting the malfunction of the at least one sensor.

* * * * *